US012698113B2

(12) United States Patent
Masurel et al.

(10) Patent No.: US 12,698,113 B2
(45) Date of Patent: Aug. 4, 2026

(54) GRIPPER-BENDER DEVICE AND MODULAR GRIPPER ASSEMBLY

(71) Applicant: VELEC SYSTEMS, Wattrelos (FR)

(72) Inventors: Maxence Masurel, Tourcoing (FR); Pierre Six, Sailly Lez Lannoy (FR)

(73) Assignee: VELEC SYSTEMS, Wattrelos (FR)

( * ) Notice: Subject to any disclaimer, the term of this patent is extended or adjusted under 35 U.S.C. 154(b) by 0 days.

(21) Appl. No.: 18/957,200

(22) Filed: Nov. 22, 2024

(65) Prior Publication Data

US 2025/0171181 A1 May 29, 2025

(30) Foreign Application Priority Data

Nov. 24, 2023 (FR) ..... 2312996

(51) Int. Cl.
*B65B 35/18* (2006.01)
*B65B 19/34* (2006.01)
*B65B 35/56* (2006.01)

(52) U.S. Cl.
CPC ..... *B65B 35/18* (2013.01); *B65B 19/34* (2013.01); *B65B 35/56* (2013.01)

(58) Field of Classification Search
CPC ..... B65B 35/38; B65B 35/58; B65B 35/56; B65B 35/16; B65B 35/18; B65B 35/36; B65B 59/04; B65B 59/005; B65B 59/001; B65B 5/08; B65B 19/34; A22C 11/008; B25J 15/0616
See application file for complete search history.

(56) References Cited

U.S. PATENT DOCUMENTS

2014/0199153 A1* 7/2014 Reinhold ..... B65H 3/0816 414/800
2014/0360137 A1* 12/2014 Richards ..... B65B 25/065 414/737
2020/0060296 A1 2/2020 Singer et al.

FOREIGN PATENT DOCUMENTS

CH 692146 A5 * 2/2002 ..... B65H 3/0883
CN 212501259 U 2/2021
EP 0569675 A1 * 11/1993 ..... B65B 19/34
EP 2689899 A1 1/2014

OTHER PUBLICATIONS

Translation of EP 0569675 (Year: 1993).*
Translation of CH 692146 A5 (Year: 2002).*

* cited by examiner

*Primary Examiner* — Thomas M Wittenschlaeger
(74) *Attorney, Agent, or Firm* — Meunier Carlin & Curfman LLC

(57) ABSTRACT

Mechanised method for bending and loading slender products having two longitudinal ends into at least one package implementing one or more gripper-bender devices and comprising the following steps of:

/a/ gripping by the gripper-bender device(s) the product(s) in a rest position on a support surface, position wherein each product has an initial length between the two longitudinal ends thereof, /b/ stressing by the gripper-bender device(s) the product(s) in a curved position, position wherein each product has a reduced length between the two longitudinal ends thereof shorter than the initial length, and, /c/ depositing and inserting by the gripper-bender device(s) the products in the curved position into said at least one package.

11 Claims, 7 Drawing Sheets

GRIPPER-BENDER DEVICE AND MODULAR GRIPPER ASSEMBLY

The present disclosure relates to a mechanised method for bending and loading products into packages, as well as a gripper-bender device for implementing such a method and an assembly comprising a plurality of such gripper-bender devices.

FIELD OF DISCLOSURE

The present disclosure falls within the field of automated industrial production methods. More precisely, the present disclosure relates to the field of loading and packaging agri-food products.

BACKGROUND

Automated and robotised installations are widely developed in the industrial production sector, and now replace operators for highly difficult operations, particularly those requiring repetitive manipulations of a significant number of goods, sometimes that are of large dimensions and/or very heavy.

Conventionally, industrial production installations for transporting, preparing and/or loading products are equipped with "picking" or "pick and place" robots. These machines select, sort and move the goods from one surface to another. In order to carry out these operations, the robots are conventionally provided with an articulated robotised arm and a system for grabbing and/or releasing a plurality of products simultaneously, typically several tens of times per minute.

In particular, agri-food industries use a set of robotised installations, and typically picking robots that make it possible to rapidly manipulate and pack the food products, from bulk food products up to the depositing thereof into a final package. Therefore, such installations using these technologies for loading food products, such as sausages, into thermoformed trays and packages are widely known.

Moreover, in industrial sectors, there is a growing need to reduce the carbon footprint and particularly, to reduce non-recyclable product waste and/or pollutants. In particular, a significant proportion of the pollution generated by the agri-food production industry comes from packages, which are mostly for single use and mainly formed of plastic materials.

Most of the industries that use these packages are trying to reduce their consumption of plastics. The main solution consists in replacing the existing packages with ecological alternatives, using environmentally friendly materials such as biomaterials that are manufactured in short circuits, reusable and/or requiring the least possible materials/energy.

On the other hand, these solutions for the moment remain too expensive for industrialists and the methods for manufacturing these alternative packages are not yet sufficiently developed for replacing all of the packages and for maintaining the production rate.

In addition, as regards foodstuffs, hygiene, sealing, composition, etc., standards for packages must be respected for the contact and the storage of products. The plastic materials and/or pollutants used in the packages meet these standards and for the moment are difficult to replace completely.

SUMMARY

The present disclosure improves the situation.

A mechanised method is proposed for bending and loading one or more slender products having two longitudinal ends into at least one package implementing one or more gripper-bender devices and comprising the following steps of:

/a/ gripping by the gripper-bender device(s) the product(s) in rest position on a support surface, the rest position being defined by the or each product having an initial length between the two longitudinal ends thereof, /b/ stressing by the gripper-bender device(s) the product(s) in a curved position, the curved position being defined by the or each product having a reduced length between the two longitudinal ends thereof shorter than the initial length, and, /c/ depositing and inserting by the gripper-bender device(s) the product(s) in the curved position into said at least one package.

The features outlined in the following paragraphs can optionally be implemented independently or in combination with one another.

According to one embodiment, said at least one package has a bottom and edges, and depositing in /c/ is obtained in the curved position of the product(s) having the reduced length, by guaranteeing an offset between the longitudinal ends of the or of each product and the edges opposite the longitudinal ends at least greater than a threshold margin.

According to one embodiment, in the initial length, the offset between the longitudinal ends of the or of each product and the edges opposite the longitudinal ends is less than the threshold margin.

According to one embodiment, the or each gripper-bender device comprises one or more suction cup(s), and the gripping in /a/ is obtained by placing the suction cup(s) in contact with the product, and placing the suction cup(s) in a negative pressure and the depositing in /c/ is obtained by stopping the negative pressure.

According to one embodiment, the support surface is a conveyor belt, having in relief parallel slots individually receiving the slender products.

According to one embodiment, the gripper-bender device(s) is (are) manipulated by a robotised arm, and the robotised arm ensures the movement of the product(s) grasped by the gripper-bender devices from the support surface in /a/, and up to the depositing in /c/.

The present disclosure also concerns a gripper-bender device that is suitable for implementing the mechanised bending and loading method, comprising:

at least one suction cup including flexible bellows, connected to at least one vacuum port for actuating a suction of the suction cup, the suction cup being configured to grasp by suction in a suction direction the product in the rest position during step /a/, and to pull by continuous suction in a retraction direction of the suction cup, collapsing the flexible bellows of the suction cup, during step /b/ by causing a movement of the product in relation to a fixed part of the gripper-bender device, and, at least one lower counter-bearing portion including at least one contact surface, in particular concave, configured to counter bear against the product during the retraction of the suction cup in a direction opposite to the retraction direction of the suction cup on the product during step /b/, in order to place it in the curved position.

According to one embodiment, the fixed part includes a system for adjusting a spacing between the suction cup(s) and said at least one counter-bearing portion configured to permit the movement of the at least one suction cup according to at least two relative positions, comprising a first position wherein a stressing of the product on the contact surface is low, the product is slightly bent and the reduced length thereof has a first value, and a second position wherein the stressing of the product on the contact surface is strong, the product is considerably bent and the reduced length thereof has a second value, different from the first value.

According to another aspect, the present disclosure also concerns a gripper-bender device that is suitable for implementing the mechanised bending and loading method, comprising three suction cups, two lateral suction cups located on either side of a central suction cup, said three suction cups including flexible bellows and each being connected to at least one vacuum port for actuating a suction of each of the three suction cups, in which the three suction cups are configured to grasp by suction in a suction direction the product in the rest position during step /a/, and to pull by continuous suction in a retraction direction of the three suction cups, collapsing the bellows of the suction cups, during step /b/ by causing a movement of the product in relation to a fixed part of the gripper-bender device, and in which said central suction cup is configured to retract according to a retraction amplitude greater than a retraction amplitude of said two lateral suction cups during step /b/, for placing the product in the curved position.

The present disclosure also concerns a modular gripper assembly for implementing the mechanised bending and loading method, comprising a main frame comprising main rails and a plurality of gripper-benders, slidingly mounted parallel with one another and one after another on said main rails, said gripper-bender devices grouped into a plurality of independent gripper groups, sliding along the main rails, and in which the main frame is equipped with at least one actuator configured to slide the plurality of gripper-bender devices along the main rails:

between a gripping position wherein the gripper-benders of said independent gripper groups are grouped in a centre of the main frame juxtaposed one after another on the main rails, and each of the two ends of the main rails is left free according to an end spacing, and a depositing position, wherein the gripper-benders of the gripper groups are disposed in a spaced position, said groups being separated from one another by a group spacing and each of the groups having a group length.

According to one embodiment, said gripper-bender devices belonging to the same group from the plurality of independent gripper groups, are secured, in pairs, by removable connecting rods, the rods engaging by two ends of each rod into two slots of the gripper-bender devices by elastic interlocking.

According to one embodiment, the method for bending and loading a plurality of products into packages, implements the modular gripper assembly, wherein said packages are of a package length longer than the group length and are of a package width and wherein the modular gripper assembly is placed in the gripping position prior to step /a/, the method comprising the following steps of:

/a/ gripping by the plurality of gripper-bender devices the plurality of products which are uniformly distributed and moving on the support surface in the rest position, /b/ stressing and bending the plurality of products in the curved position by the plurality of gripper-bender devices, /c/ placing the modular gripper assembly in the depositing position wherein the plurality of gripper-bender devices gripping the plurality of products in the curved position is divided into a plurality of independent gripper groups (Gr), each independent gripper group being of the group length, and, /d/ depositing and inserting said plurality of products in the curved position gripped by each independent gripper group into each package.

According to one embodiment, the products are food products, in particular sausages.

BRIEF DESCRIPTION OF THE DRAWINGS

Other features, details and advantages will appear upon reading the detailed description hereinafter, and on analysis of the appended drawings, wherein:

FIG. 1 shows a front view of a gripper-bender device comprising a fixed part and a portion for counter bearing with concave contact surfaces. The gripper-bender device further comprises bellows suction cups, each connected to a vacuum port, and that can be adjusted with one another thanks to a system for adjusting the spacing of the suction cups. The fixed part comprises attachment slots.

FIG. 2 shows a three-quarter view of the gripper-bender device according to FIG. 1. This view shows a preferred embodiment of the concave contact surfaces.

FIG. 3 shows a consecutive view of FIG. 1, where the suction cups of the gripper-bender device grasp a slender product, in rest position, having an initial length. Under the slender product is shown a cross section of a package of package length shorter than the initial length of the product in rest position.

FIG. 4 shows a consecutive view of FIG. 3, where the suction cups of the gripper-bender device suck the product towards the fixed part of the gripper-bender, collapsing the bellows of the suction cups in contact with the product. The concave contact surfaces stress the ends of the product, in a direction opposite to the suction direction of the suction cups. The slender product is then placed in the curved position thereof, and is now of reduced length, shorter than the initial length in rest position, and shorter than the length of the package by a threshold margin.

FIG. 5 shows a modular gripper assembly, implementing a plurality of gripper-bender devices, as shown in FIGS. 1 to 4. The assembly illustrated here, comprises twenty-four gripper-bender devices, slidingly attached to main rails of a main frame of the assembly.

FIG. 6 is a view of a second position of the modular gripper assembly shown in FIG. 5, where the gripper-bender devices slide along the main rails and are distributed into three groups of gripper-benders. In this case shown, there are three groups of eight gripper-benders, separated by a group spacing, and each group extends along a group length.

FIG. 7 shows a top view of the modular gripper assembly, devoid of gripper-bender devices. This view highlights the main frame, the main rails, a centre of the frame, actuators as well as connecting rods.

FIG. 8 is a consecutive view of FIG. 7, of the modular gripper assembly equipped with the groups of gripper-benders, distributed according to three groups of eight gripper-benders. The two groups of lateral gripper-benders are positioned at the longitudinal ends of the main rails, and the central group is fixed at the centre of the main frame.

FIG. 9*a* shows a first step of a method for bending and loading a plurality of products into packages, implementing the modular gripper assembly, wherein the modular gripper assembly is positioned above a support surface whereon a plurality of slender products in rest position are moved.

FIG. 9*b* shows a second step of the method for bending and loading a plurality of products into packages, wherein the products are grasped by the suction cups of the gripper-bender devices of the modular gripper assembly.

FIG. 9*c* shows a third step of the method for bending and loading a plurality of products into packages, wherein the suction cups suck the products the ends of which are stressed and abutting against the contact surfaces of the gripper-benders. The products are then placed in curved position.

FIG. 9*d* shows a fourth step of the method for bending and loading a plurality of products into packages, wherein the groups of gripper-benders holding the products in curved position are formed. In this figure, three groups of eight gripper-benders, each holding a product in curved position, are shown.

FIG. 9*e* shows a fifth step of the method for bending and loading a plurality of products into packages, wherein the groups of products are placed above packages for the loading thereof. The packages have a package width substantially wider than the group length, and a package length, substantially longer than the reduced length of the products in curved position. In this figure, the three groups of products are placed above three packages. The arrows illustrate the depositing direction of the groups of products in the packages, by deactivating the negative pressure of the suction cups of the gripper-benders.

FIG. 10 shows a front view of a second embodiment of the gripper-bender device comprising a fixed part whereon three bellows suction cups, two lateral suction cups and a central suction cup, are positioned, grasping a slender product, in rest position. Each of the three suction cups is connected to a vacuum port. The lateral suction cups may be adjusted in relation to one another thanks to a system for adjusting the spacing of the suction cups and the central suction cup is fixed. The fixed part further comprises attachment slots.

DETAILED DESCRIPTION OF THE EMBODIMENTS

The drawings and the description hereinafter essentially contain elements of a certain nature. Hence, they could not only be used to better understand the present disclosure, but also contribute to the definition thereof, where appropriate.

The present disclosure relates to a mechanised method for bending and loading one or more slender products O, having two longitudinal ends, into at least one package E implementing one or more gripper-bender devices. The slender products O may typically be food products, for example sausages, in particular of animal, or even, plant origin.

The method comprises the following steps of:

/a/ gripping by the gripper-bender device(s) the product(s) O in a rest position PR on a support surface 3, position wherein the or each product O has an initial length Li between the two longitudinal ends thereof, /b/ stressing by the gripper-bender device(s) the product(s) O in a curved position PC, position wherein the or each product O has a reduced length Lr between the two longitudinal ends thereof shorter than the initial length Li, and, /c/ depositing and inserting by the gripper-bender device(s) the product(s) O in the curved position PC into said at least one package E.

Such a method makes it possible to reduce the size of the products O to be packaged by bending them. The curved products, of reduced length Lr, can then be inserted into smaller packages. Alternatively, rather than use smaller packages, it is also possible to insert a larger number of curved products into the same package, or to insert longer products. This may have for example the advantage of getting rid of existing stocks of packages of conventional dimensions, loaded with more products O.

Figure 1:
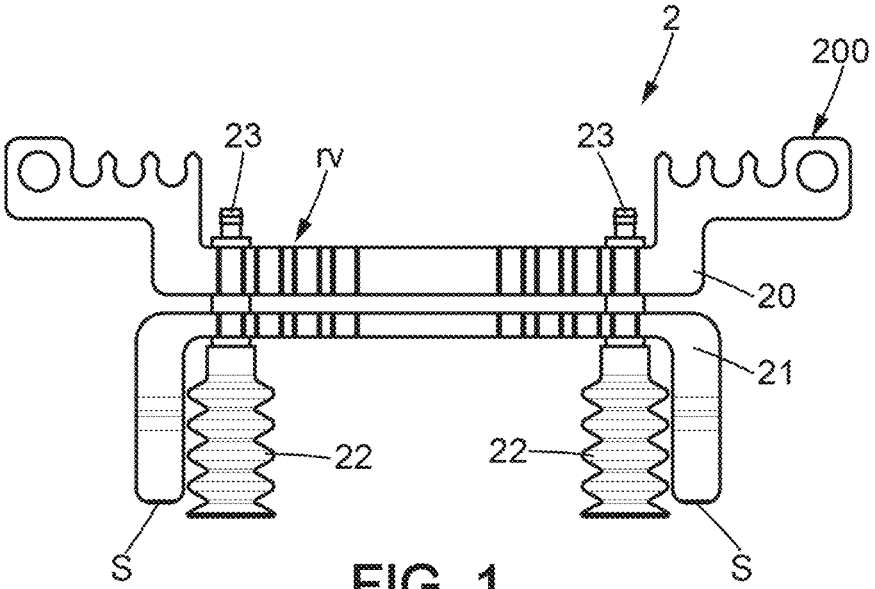
FIG. 1
Figure 2:
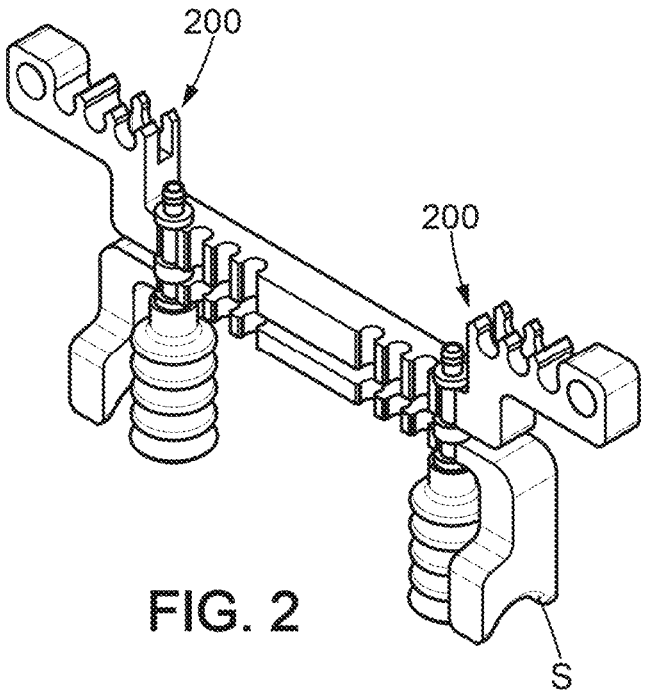
FIG. 2
Figure 3:
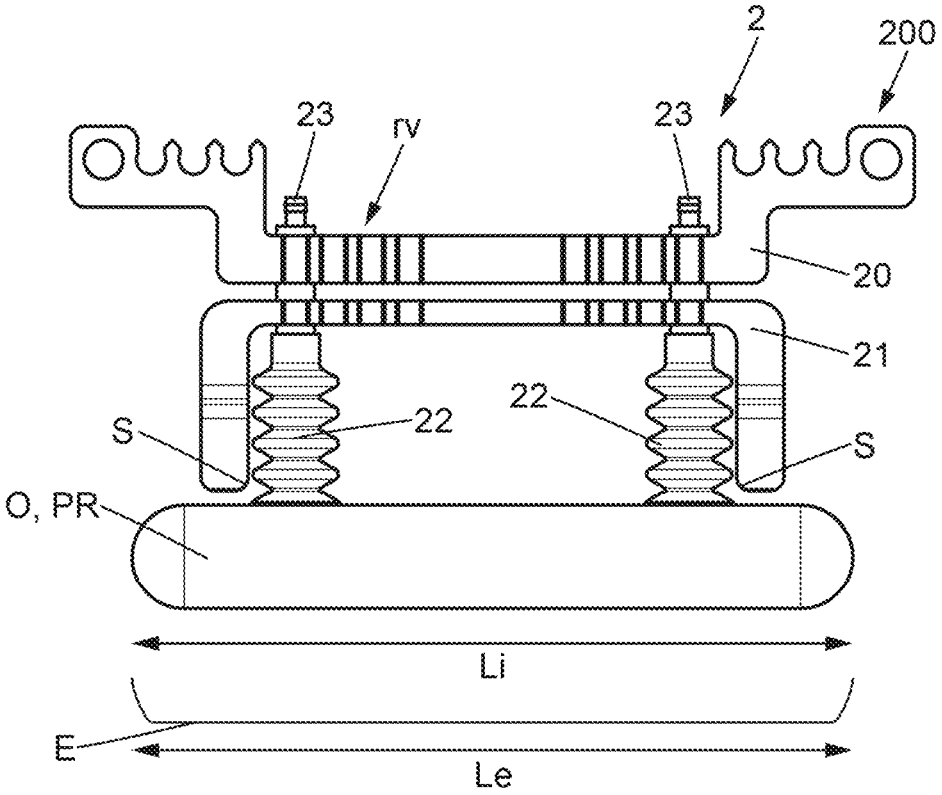
FIG. 3

As illustrated in FIG. 2, and generally, the package E may have a bottom and edges. In particular, according to one embodiment, the package is in the form of an airtight and sealable tray. For example, the tray is thermoformed, made of a polyethylene (PE), polyethylene terephthalate (PET) and/or polypropylene (PP), and/or extruded polystyrene (thermoformed PSE) plastic and closed by a seal for example a sealable food film suitable for freezing, made of PE or PP. Any other material the composition of which allows contact with a naked product, particularly food, may be suitable.

The packages may further comprise recyclable materials, for example recycled plastics, of the rPET type. It is also possible to use ecological packages, using biodegradable and/or eco-designed components, such as compostable trays made of moulded cellulose. In particular, less voluminous and lighter alternatives are preferred for the storage, manufactured with the least possible materials, maintaining an optimal sealing and vacuuming of products.

Depositing in the package E in step /c/ of the method is obtained in the curved position PC of the product(s) O of reduced length Lr. This depositing is carried out by guaranteeing an offset between the longitudinal ends of each product O and the edges of the package E opposite the longitudinal ends at least greater than the threshold margin dm, as shown in FIG. 2.

The threshold margin dm is a safety margin, of dimensions in particular between 0 and 10 mm, for example 5 mm. It is chosen to ensure insertion of the products O into the package E without forcing and without damaging the products, particularly at the ends thereof. Conversely, it is preferable that the threshold margin is not too high, because the size of the products O would not be optimised: the products in the curved position PC, particularly in the case of flexible and deformable agri-food products, tend to naturally revert back to the initial rest position PR thereof, and therefore the length thereof substantially increases by tending towards the initial length Li, once inserted into the package E.

Moreover, the offset between the longitudinal ends of each product O in the rest position PR and of initial length Li, on the one hand, and the edges of the package E, on the other hand, is less than the threshold margin dm. In other words, the product O in the rest position PR thereof is too close to the edges of the package E to ensure the robotised insertion thereof into the package E with reliability, or even possibly the product may longitudinally protrude from the package E, in relation to the edges.

According to the present disclosure, the method comprises installing gripper-bender devices 2 to grab, bend then deposit the products O. To this end, the gripper-bender device 2 may comprise one or more suction cups 22. The gripping in step /a/ is then obtained by placing the suction cup 22 in contact with the product O, then placing it in negative pressure thereof. The depositing of the product O in step /c/ is subsequently typically obtained by stopping the negative pressure.

The support surface 3 for carrying the products O is particularly a conveyor belt, having in relief parallel slots, individually receiving the slender products O. One example of support surface 3 can be seen in FIG. 9*a*.

Such a support surface 3 with parallel slots makes it possible to individually arrange the products O, then in the rest position PR, respectively in the slots, and distributes them uniformly, and in the suitable gripping direction in relation to the suction cups 22 of the gripper-bender devices 2.

According to one embodiment, the gripper-bender device(s) are manipulated by a robotised arm, which ensures the movement of the product(s) O grasped by the gripper-bender device(s) 2 from the support surface 3 in /a/, and up to the depositing in /c/.

The robotised arm may for example be equipped with devices for recognising shapes, dimensions, etc., such as cameras for optimising the movement and the production rate.

Figure 4:
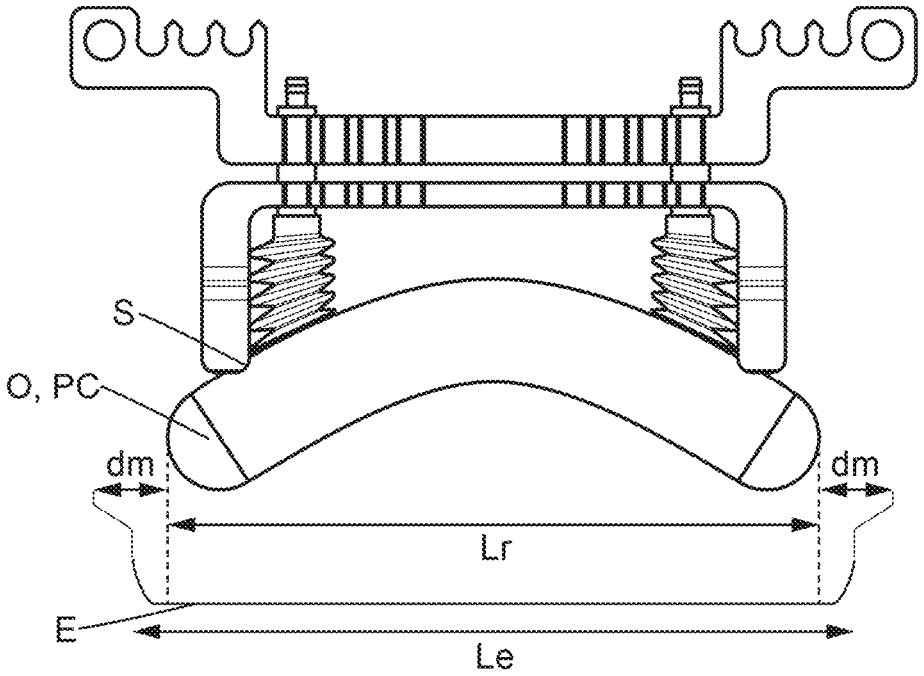
FIG. 4

According to one embodiment of the invention, the gripper-bender device 2 that is suitable for implementing the mechanised bending method, particularly illustrated in FIGS. 1 to 4, comprises at least one suction cup 22 including flexible bellows, connected to at least one vacuum port 23 for actuating the suction of the suction cup 22. The suction cup 22 is thus configured to grasp by suction in a suction direction (vertically) the product O during step /a/, illustrated in FIG. 3, and to pull by continuous suction in a retraction direction of the suction cup 22 (during conventional use, upwards), thus collapsing the bellows of the suction cup 22, during step /b/, and as illustrated in FIG. 4. The bellows thus collapsed perfectly follow the surface of the product O grasped by the suction cup. The continuous retraction of the suction cup 22 during step /b/ also causes a movement (upwards) of the product O in relation to a fixed part 20 of the gripper-bender device 2.

The gripper-bender device 2 further comprises at least one counter-bearing portion 21 including at least one contact surface S, in particular concave. Such a concave contact surface S is thus configured to counter bear against the product O during the retraction of the suction cup 22, in a direction opposite (downwards) to the retraction direction of the suction cup 22 on the product O during step /b/. The product O thus pulled (upwards) by the suction cup 22, and the ends thereof abutting against the surfaces S, bends in the curved position PC, as shown particularly in FIG. 4.

According to a preferred embodiment, the gripper-bender device 2 comprises two suction cups 22 positioned during gripping on either side of the centre of the product, each located on a portion of the product O defined between the centre and one of the ends of the product O. The contact surfaces S with counter-bearing function, are located on either side of the two suction cups 22, in the direction separating the two suction cups. Each of the surfaces S is located between one of the suction cups 22 and one of the ends of the product O during gripping.

According to an alternative embodiment, the position of the suction cups and of the contact surfaces S on the gripper-bender device may be reversed, the suction cups 22 being located between the contact surfaces S and the ends of the product O. In such a configuration, the bending of the product O is carried out by stressing the central portion of the product O, where the contact surfaces S are placed in contact with the central portion of the product O, counter bearing, and the ends of the product O are sucked and pulled by the suction cups 22.

As shown in the various figures, and according to a preferred embodiment, the suction cups 22 have a circular cross section. They may also be chosen with other shapes, for example with an oblong shape, and with variable dimensions, adapted to the product O to be grasped. For example, for the gripping of a sausage, the suction cup is preferably circular, and the diameter thereof may be between 5 and 20 mm, such as 15 mm.

The suction cup 22 may further comprise a hollow body made of elastomer material, such as vinyl, silicone or nitrile, and comprises a plurality of bellows so as to adapt and be fully in contact with the curved faces of the product O to be grasped.

The surface S being configured to bear against the product O, it is also preferably adapted to the particular shape of the latter. In particular, in the case of food products O, such as sausages, the curvature of the surface S is designed according to a diameter greater than the transverse diameter of the sausages, for example the diameter of the curvature of the surface S is equal to 1.2 times the transverse diameter of the sausages, and up to 3 times the transverse diameter of the sausages. Preferably, the surface S comprises a coating made of smooth and flexible materials, such as alimentary silicone, in order to reduce the damage on the product O.

Moreover, the suction cup 22, the bellows thereof, as well as the contact surfaces S, do not have any retaining recesses and are suitable for food applications, with specific materials for food contact, meeting FDA and European CE food standards (EN 1672-2:2005+A1:2009, ISO 14159:2002). The device thus meets the 3A and EHEDG standards.

The placing in negative pressure of the suction cup 22 is ensured by a vacuum source, with a Venturi vacuum pump for example. The vacuum source is external to the gripper device, for example positioned on the robotised arm. It is also possible to alternatively use a compressed air source with a pneumatic port to generate the changes in pressure of the suction cup 22.

In order to obtain the best product O initial length Li to the desired final reduced length Lr ratio, the gripper-bender device 2 according to the present disclosure may further include a system for adjusting the spacing rv on the fixed part 20 thereof, between the suction cup(s) and the counter-bearing portion 21, that can be seen in FIGS. 1 to 4. The system for adjusting the spacing rv is thus configured to permit the movement of the suction cups 22 according to at least two relative positions, comprising a first position wherein the stressing of the product O on the contact surface S is low, the product O is slightly bent and the reduced length thereof Lr has a first value, and a second position wherein the stressing of the product O on the contact surface S is strong, the product O is considerably bent and the reduced length thereof Lr has a second value, different from the first value.

The adjustment system, may include a plurality of assembly orifices, spaced lengthwise in a lengthwise direction of the support. The plurality of assembly orifices making it possible to selectively insert an attachment rod of the suction cup 22, and attach it, for example the installation of a screwed nut on a threaded end protruding from the rod.

The first value is defined to be lower than the second value. Preferably, the central portion of the product O in the curved position PC is offset by 20 mm in relation to the ends of the product O.

When the device comprises two suction cups 22, the two suction cups may typically be adjusted simultaneously, symmetrically in relation to a middle of the support.

Moreover, depending on the shape of the product O, it is absolutely possible to asymmetrically adjust the suction cups, so that the product O is more curved towards one end than the other. This may in particular apply for products O themselves asymmetrical, particularly food products, such as pieces of meat for example.

Moreover, the system for adjusting the spacing rv advantageously makes it possible to adapt the gripper-bender device 2 to products O of different initial lengths Li, for example, different types of sausages, products having a more or less increased resistance to stressing from one end to the other, or to adapt to smaller packages E.

Figure 10:
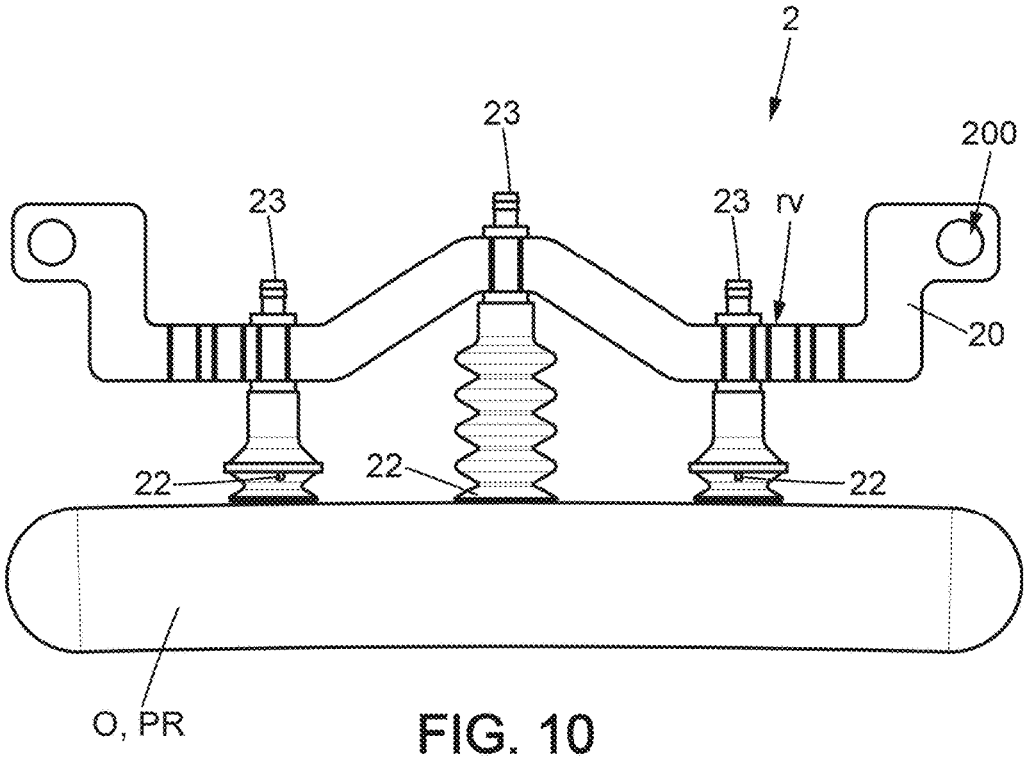
FIG. 10

According to another possible embodiment shown in FIG. 10, the gripper-bender device 2 comprises three suction cups 22, namely two lateral suction cups located on either side of a central suction cup. The three suction cups 22 include flexible bellows and are each connected to at least one vacuum port 23 for actuating the suction of each of the three suction cups 22. In this embodiment, the three suction cups 22 are configured to grasp by suction in a suction direction the product O in the rest position PR during step /a/, and to pull by continuous suction in a retraction direction of the three suction cups 22, collapsing the bellows of the suction cups 22, during step /b/ by causing a movement of the product O in relation to a fixed part 20 of the gripper-bender device 2. The central suction cup is configured to retract according to a retraction amplitude greater than a retraction amplitude of the lateral suction cups during step /b/, for placing the product O in the curved position PC.

In this embodiment, the central suction cup is then configured to grasp the central portion of the product O in the rest position PR, and the two lateral suction cups are configured to grasp the ends of the product O.

The difference between the retraction amplitude of the central suction cup and the retraction amplitude of the two lateral suction cups in step /b/, corresponding to the offset between the central portion and the ends of the product O in the curved position PC, is preferably 20 mm.

Alternatively, it is possible to design lateral suction cups with a retraction amplitude greater than the retraction amplitude of the central suction cup. In such a case, the product O is placed in the curved position thereof by the ends thereof, sucked and pulled by the lateral suction cups.

Preferably, the three suction cups 22 are at the same level in the deployed position thereof, prior to step /a/, in order that they can be simultaneously placed in contact on the product O to be grasped in the rest position PR during step /a/.

The three suction cups 22 may comprise a hollow body made of elastomer material, such as vinyl, silicone or nitrile, or any other material meeting food standards, and a plurality of bellows. According to a preferred embodiment, the three suction cups 22 have a circular cross section, and preferably, the central suction cup has a diameter and a length greater than the diameters and lengths of the lateral suction cups as well as a significant number of bellows.

In addition, in this embodiment, the fixed part 20 may comprise a system for adjusting the spacing rv of the two lateral suction cups. The adjustment system rv is then configured to permit the movement of the lateral suction cups according to at least two relative positions, depending on the desired offset between the central portion and the ends of the product O in the curved position PC. Preferably, the central suction cup is fixed and cannot be moved on the fixed part 20.

In the industrial production context, the present disclosure also relates to a modular gripper assembly 1 for implementing the mechanised bending and loading method described above, and including a plurality of gripper-bender devices 2. The modular gripper assembly 1 is particularly shown in FIGS. 5 to 8.

Figure 5:
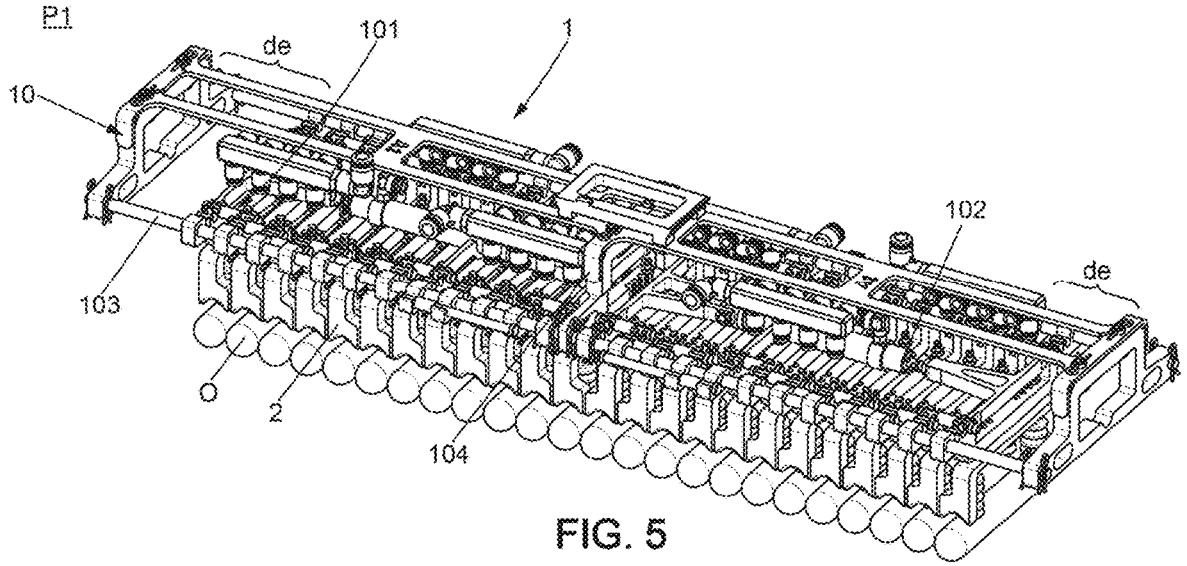
FIG. 5
Figure 6:
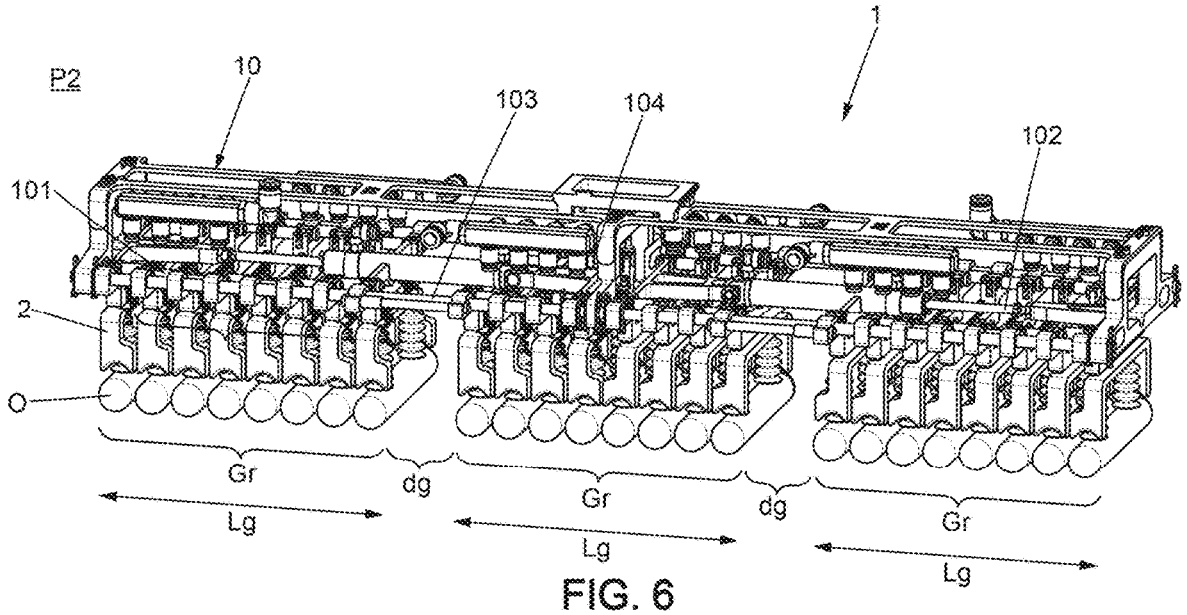
FIG. 6
Figure 7:
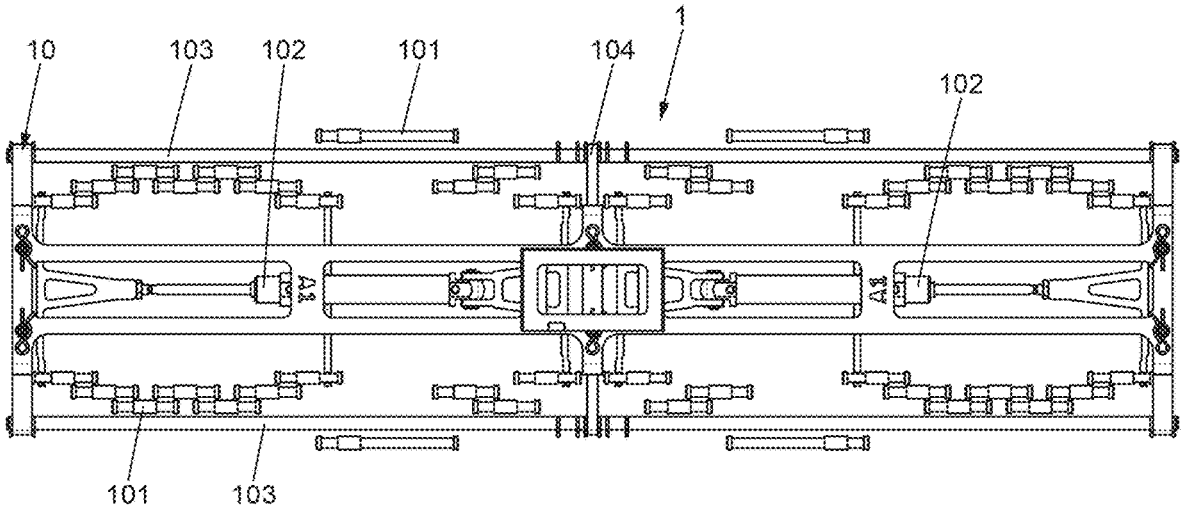
FIG. 7
Figure 8:
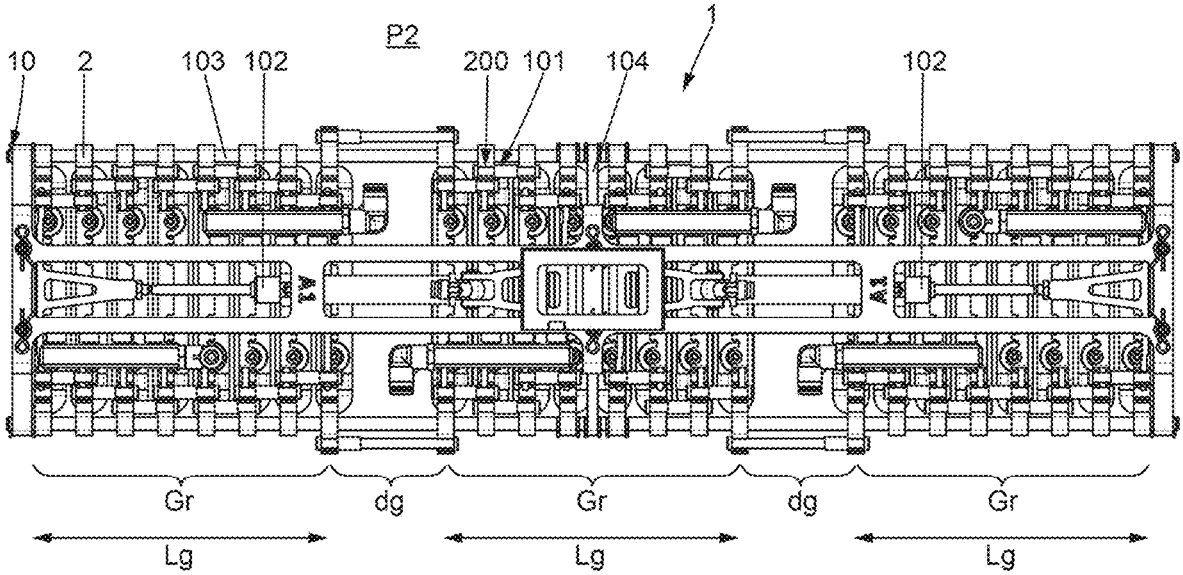
FIG. 8

Such a modular gripper assembly 1 comprises a main frame 10 comprising main rails 103 whereon the plurality of gripper-benders 2 are slidingly mounted, parallel with one another and one after another (FIG. 5). The gripper-bender devices 2 are grouped into a plurality of independent gripper groups Gr, sliding along the main rails 103 (FIGS. 6, 7 and 8). The main frame 10 is equipped with at least one actuator 102 that can be seen particularly in FIG. 7, configured to slide the plurality of gripper-bender devices 2 along the main rails 103.

Furthermore, the gripper-bender devices 2 slide along the main rails 103;

- between a gripping position P1 illustrated in FIG. 5, wherein the gripper-benders 2 of each gripper group Gr are grouped in the centre 104 of the main frame 10, juxtaposed one after another on the main rails 103, and each of the two ends of the main rails 103 is left free according to an end spacing de, and,
- a depositing position P2 illustrated particularly in FIG. 6, wherein the gripper-benders 2 of the gripper groups Gr are disposed in a spaced position, where the groups Gr are separated from one another by a group spacing dg and each of the groups Gr having a group length Lg.

In particular, such an assembly may be mounted on an automated robotic arm, and equipped with devices for recognising shapes, dimensions, etc., such as cameras.

In a preferred embodiment, and as shown for example in FIG. 7, the assembly 1 preferably comprises two actuators 102. These two actuators 102 include a cylinder system, with a piston and a retractable rod, each connected to a group Gr of gripper-benders 2. In the gripping position P1, the rod is retracted in the cylinder. In the depositing position P2 for separating the groups Gr, the rod is actuated by the piston and deployed to push and slide a group Gr along the main rails 103.

Alternatively, it is also possible to design each actuator 102 in such a way that the rod is deployed in the gripping position P1, and retracted in the depositing position P2 for separating the groups, in order to pull and slide a group Gr.

Such a cylinder device may for example be a single acting or double acting cylinder, actuated by an air passage system with external pneumatic ports.

In the embodiment of the invention, illustrated in FIGS. 5 to 8, the main rails 103 are dimensioned to receive three groups Gr of eight gripper-benders 2, with a spacing dg between each group Gr.

It is possible to alternatively design any larger or smaller modular gripper assembly. In particular, the main rails 103 thereof and/or the main frame 10 thereof may be dimensioned in order to receive more or less gripper-benders 2, and/or more or less groups Gr, and/or with spacing dg between each group Gr that is more or less large depending on the size of the products O, and/or the number of products O to be loaded per package E, and/or the simultaneous number of packages E, and/or the specific dimensioning of the available robotised installation (for example support surfaces 3), etc.

Furthermore, the gripper-bender devices 2 according to the present disclosure, belonging to the same group Gr, are secured, in pairs, according to an advantageous embodiment by removable connecting rods 101, as shown in FIGS. 6 and 8. The rods 101 engage by the two ends thereof into two slots 200 of the gripper-bender devices 2 by elastic interlocking.

The connecting rods 101 are slender elements, and preferably formed by at least one thin portion of smaller radius, whereon the gripper-benders 2 may be attached, or even slide, and by at least one thick portion of larger radius, whereon the gripper-benders 2 cannot slide. The ends of the connecting rods 101 are each provided with a stop.

In a preferred embodiment and shown for example in FIG. 8, the connecting rods 101 are in two groups:

- a first group of long connecting rods, are positioned between the groups Gr of gripper-benders 2. Only the gripper-benders 2 of the ends of groups Gr are attached to these removable rods (for example in FIG. 8, from left to right, the eighth, the ninth, the sixteenth and the seventeenth gripper-benders 2), in elastic interlocking, by the slots 200 thereof. The maximum length of the group spacing dg is shorter than the long connecting rods. The long connecting rods ensure the sliding connection between two gripper-bender devices 2 of two successive groups Gr, following the rails 103, permitting moving two gripper-bender devices 2 closer together, in the gripping position P1, and a spacing between the two groups Gr according to a limited travel and determined by the long connecting rod, setting the spacing of the two groups Gr, in the depositing position P2;
- a second group of short connecting rods, holds the gripper-bender devices 2 secured to one another within the same group Gr. These short connecting rods are configured to leave no mechanical gap between two successive gripper-benders 2, during the sliding of the groups Gr along the main rails 103.

In the embodiment shown, the gripper-benders 2 are attached to the connecting rods by a clip system and circlips. Any suitable alternative attachment device can be used.

Preferably, the length of the short connecting rods is chosen depending on the length Lg of the groups Gr of necessary products O, typically much shorter than the length of the packages E to be loaded, and in particular of determined length to set the gap between the two gripper-bender devices 2 during the gripping position P1. This gap typically corresponds to the centre-to-centre distance separating the parallel slots of the support surface/conveyor 3. The length of the long connecting rods is chosen depending on the necessary spacing between the groups Gr and the packages E, and in order to set the spacing dg between the successive groups Gr in the depositing position P2.

The gripper assembly 1 including removable connecting rods, advantageously makes it possible to rapidly reconfigure the number of gripper-bender devices 2, by group Gr. Such a modular design, including gripper-bender devices 2, removable from one another, and connecting rods, advantageously makes it possible to secure the gripper-bender devices 2 to one another by means of said short and long rods, in accordance with various possible configurations.

Such a modular design offers a rapid adaptation of the configuration of the gripper assembly 1 to the dimensions of the package E, and/to the number of food products O to be grasped by group Gr, or even of the space separating two successive packages E during the depositing.

According to a preferred embodiment and in the case where there is an odd number of groups Gr, in order to optimise the separation of the groups Gr along the main rails 103, it is also possible to attach to the main frame 10 the gripper-benders 2 of the central group Gr. This is for example illustrated in FIG. 8, where the two central gripper-benders 2 of the group Gr, located on either side of the centre 104 of the main frame 10 (in FIG. 8, from left to right, the twelfth and thirteenth gripper-benders), are attached immobile and secured to the centre 104 of the main frame 10. With such a configuration, the lateral groups Gr, the gripper-benders 2 of which are secured to one another by the short connecting rods 101, are spaced apart by the actuators 102 of the central group Gr towards the ends of the main frame 10, which remain attached to the centre 104.

Of course, it is possible to design any other suitable device for separating the groups Gr of gripper-benders 2. For example, it is possible to envisage an actuator 102 for each group Gr to be separated, or to replace the rods with removable stops on the main rails 103.

Moreover, the present disclosure also relates to the mechanised method for simultaneously bending and loading a plurality of products O into packages E, implementing the modular gripper assembly 1 thus described.

Figure 9A:
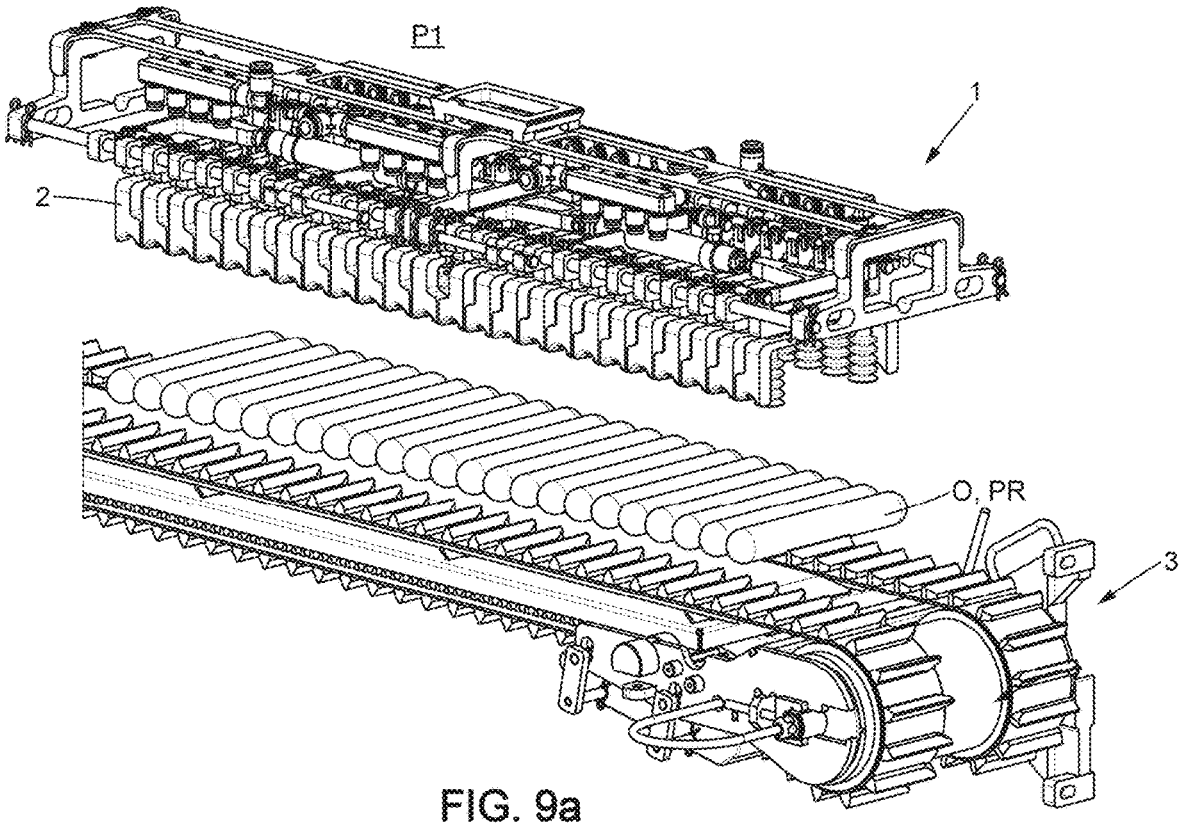
FIG. 9*a*
Figure 9B:
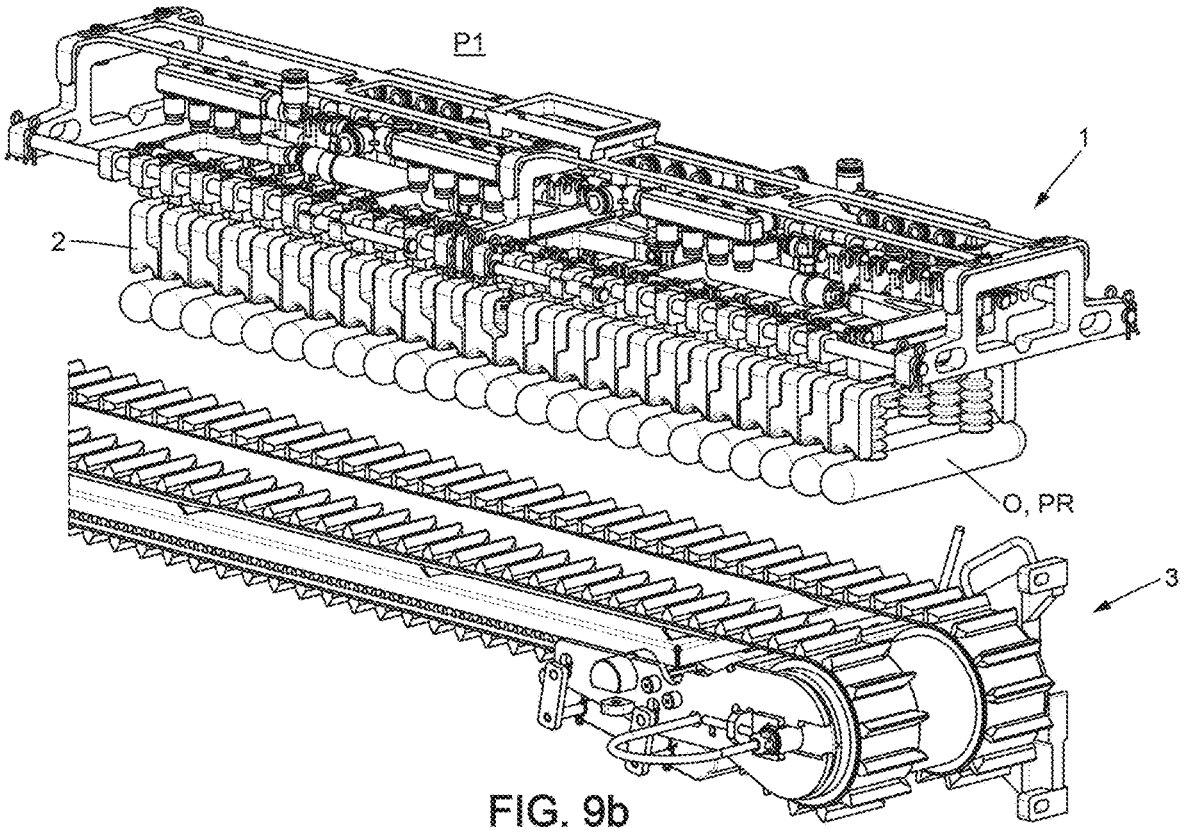
FIG. 9*b*
Figure 9C:
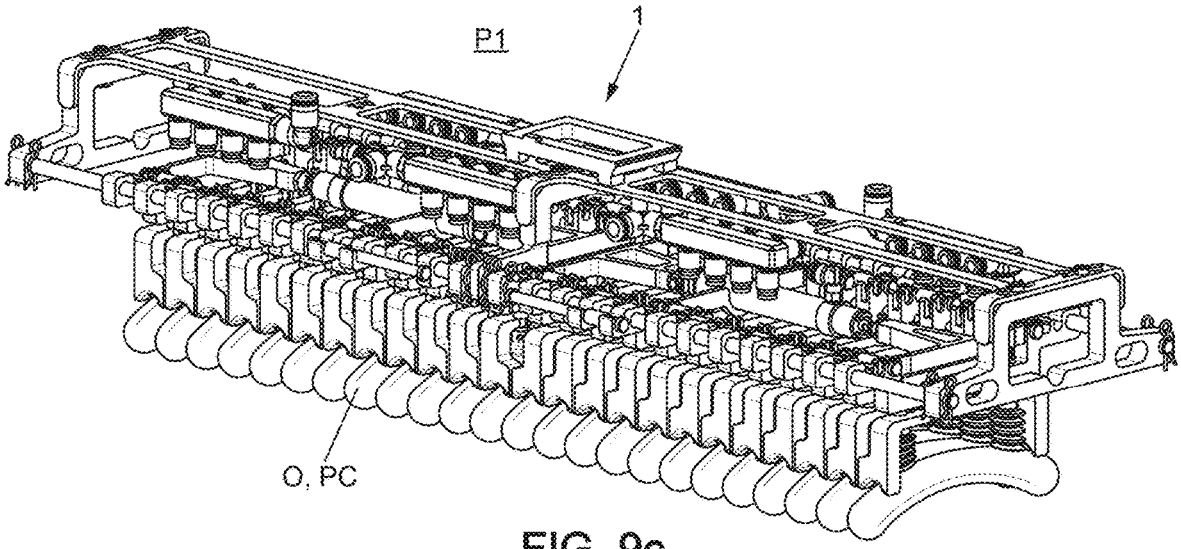
FIG. 9*c*
Figure 9D:
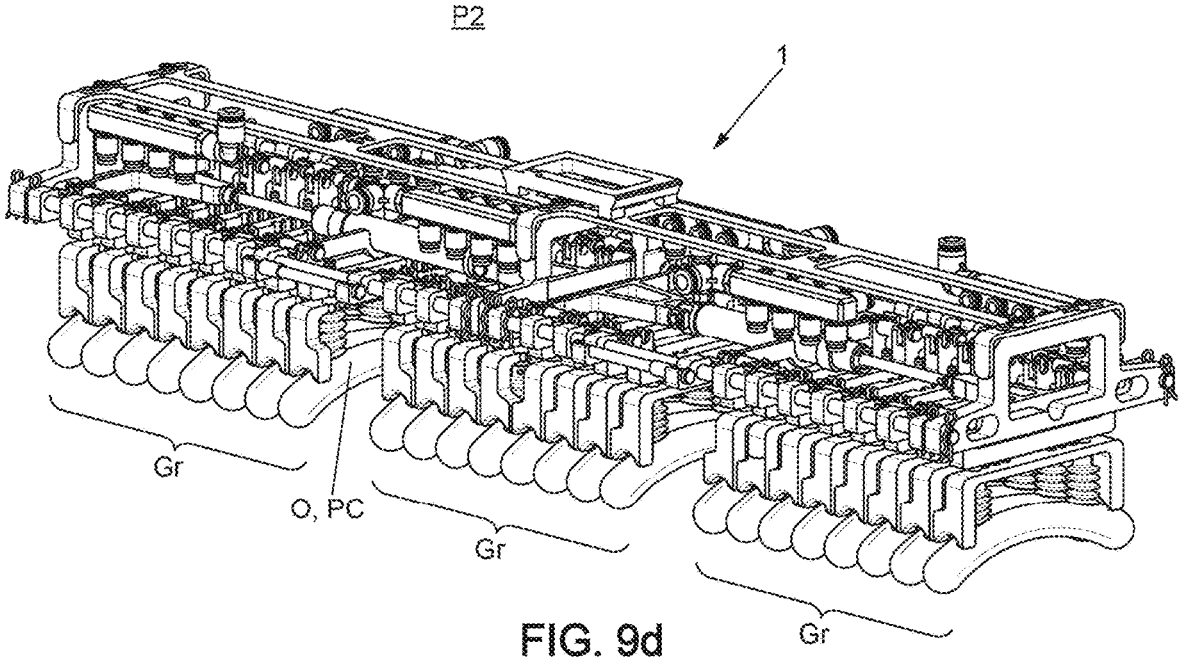
FIG. 9*d*
Figure 9E:
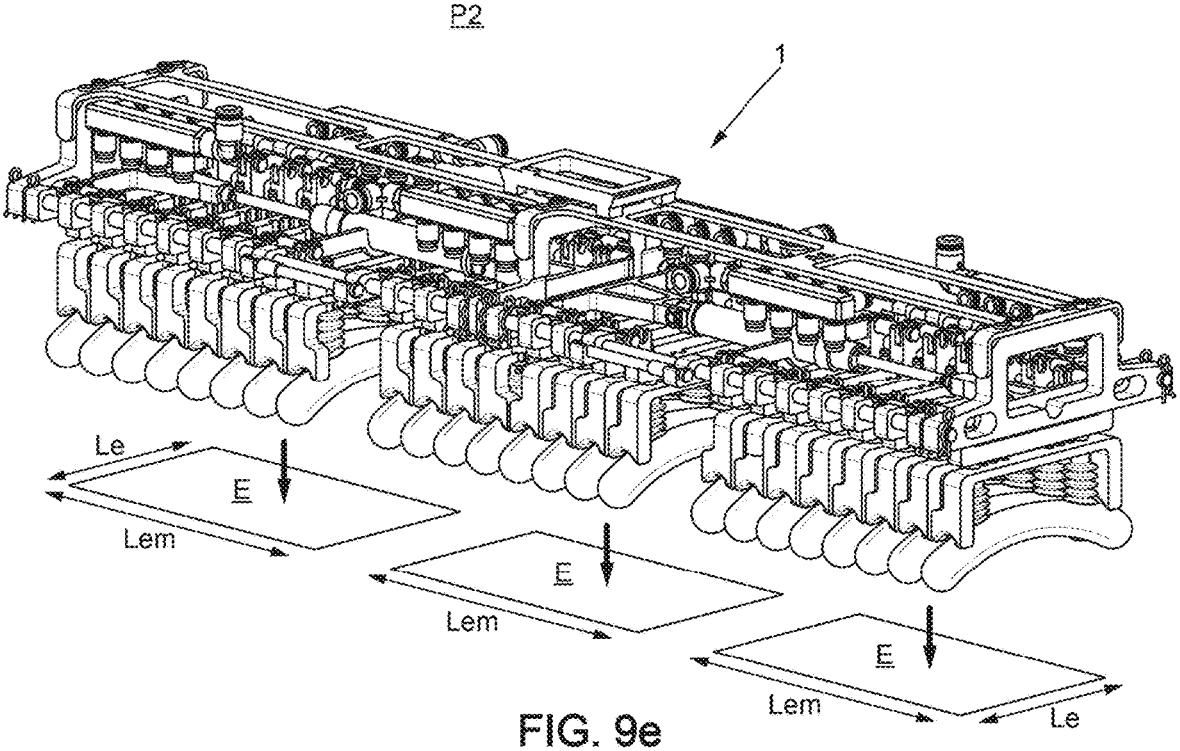
FIG. 9*e*

In this method, particularly illustrated in FIGS. 9*a* to 9*e*, the packages E are of length Lem, longer than the group length Lg, and of package width Le, and the modular gripper assembly 1 is placed in the gripping position P1 prior to step /a/ (FIG. 9*a*). The method then comprises the following steps of:

- /a/ gripping by a plurality of gripper-bender devices 2 the plurality of uniformly distributed products O moving on the support surface 3 in the rest position PR (FIG. 9*b*),
- /b/ stressing and bending the plurality of products O by the plurality of gripper-bender devices 2 in the curved position PC, (FIG. 9*c*),
- /c/ placing the modular gripper assembly 1 in the depositing position P2 wherein the plurality of gripper-bender devices 2 holding the plurality of products O in the curved position PC is divided into a plurality of independent gripper groups Gr, each independent gripper group Gr being of group length Lg (FIG. 9*d*), and,
- /d/ depositing and inserting each independent gripper group Gr of products in the curved position PC into each package (FIG. 9*e*).

Preferably, all of the steps of the method are performed by the automated robotised arm.

Thus, prior to step /a/ of FIG. 9*a*, the support surface 3 continuously carries the products O, each fitted in the distinct slot thereof, in the rest position PR. The modular gripper assembly 1 is positioned above the support surface 3 by the robotised arm, in the gripping position P1. The vacuum source does not generate negative pressure of the suction cups 22 of each gripper-bender device 2.

In step /a/ of FIG. 9*b*, the modular gripper assembly 1 is moved closer by the robotised arm to the products O on the support surface 3, until the suction cups 22 come into contact with the products O. On contact with the products O, the suction cups 22 are placed in negative pressure by activating the vacuum source, for the simultaneous gripping of the plurality of products O.

Preferably, at the end of step /a/, once the products O have been grasped, the robotised arm positions the modular gripper assembly 1 at a distance from the support surface 3.

In step /b/ of FIG. 9*c*, the negative pressure and the continuous suction of the suction cups 22 produces the collapse of the bellows of the suction cups perfectly in contact with the grasped products O. The suction cups retract in this way, and the products O are pulled towards the fixed part 20 of the gripper-bender devices 2. The ends of the products O thus abut against the counter-bearing portion 21 and against the contact surfaces S. During the continuous suction of the suction cups 22, the ends of the products O are held by the contact surfaces S in a low position, while the central parts of the products O are held by the suction cups 22 retracted in a high position. This opposing movement between the ends and the central parts of the products O generates the simultaneous bending of the products O in the curved position PC.

During step /c/, illustrated in FIG. 9*d*, the gripper-bender devices 2 holding the curved products O are separated into several independent gripper groups Gr, by the actuators 102 of the modular gripper assembly 1. The connecting rods 101 ensure the separation of the groups Gr according to the group spacing dg. The independent gripper groups Gr thus formed are of length Lg, shorter than the length Lem of the packages E wherein the products O must be loaded.

Preferably, the difference between the length Lg and the length Lem of the packages E may vary between 0 and 100 mm.

In the illustration shown in FIG. 9*d*, there are two actuators 102 configured to each push an independent gripper group Gr towards an opposite end of the main rails 103, and two connecting rods 101 are placed between the eighth and the ninth gripper-bender devices and between the sixteenth and the seventeenth gripper-bender devices respectively and from left to right. This shown configuration thus forms three independent gripper groups Gr of eight gripper-bender devices 2, two independent gripper groups Gr are placed at the ends of the main rails 103, and a third independent gripper group Gr is held in the centre 104 of the frame, with four gripper-bender devices 2 located on either side of the centre 104. In detail, by passing from the gripping position P1 to the depositing position P2, the two actuators 102 actuate the rods thereof that deploy and push on each of the lateral independent gripper groups Gr of gripper-bender devices 2 towards the longitudinal ends of the main rails 103. The two lateral independent gripper groups Gr thus detach from the central independent gripper group Gr close to the immobile centre 104, until the group spacing dg is formed between them.

Steps /b/ and /c/ can be implemented in any order or simultaneously. For example, it is possible to separate the independent gripper groups Gr of products O prior to the stressing thereof in the curved position PC.

During step /d/ , shown in FIG. 9*e*, each independent gripper group Gr of gripper-bender devices holding the curved products O is positioned above one of the packages E to be loaded. In order to deposit the products O, the suction of the suction cups 22 by negative pressure is deactivated, releasing the curved products O that are placed one after another in the package E.

According to a preferred embodiment, prior to step /d/ , or during step /d/ before releasing the products O, the modular gripper assembly 1 is positioned close to and just above the packages E to be loaded, so as to avoid damaging the products O and to preserve the reduced length Lr thereof as much as possible when they are released.

Moreover, the packages E may move on another conveying surface not shown, preferably comprising slots adapted to the dimensions of the packages in order to position them perfectly below the modular gripper assembly 1 for loading the independent gripper groups Gr of products O in the curve position PC. In addition, during the depositing step /d/ , the packages E are preferably immobile in order to receive the products O.

Once the products O have been loaded in the packages E, a final sealing step may be implemented for example by in-line thermoforming, or by an industrial sealer of the production line, hermetically applying a plastic firm on the products O.

For correct performance of the method described above, it is possible to provide means ensuring the checking of the progress of each step, particularly, if the correct number of products O is grasped by the gripper-bender devices 2, if the packages E are positioned properly below the products O in step /d/ , if the products are correctly in the curved position PC, or any other checking point. This can be ensured for example in an automated way, conventionally by cameras or shape/dimension recognition devices equipping the robotised arm, or by an operator.

According to one embodiment of the invention, the products O are food products, in particular sausages.

LIST OF THE REFERENCE SIGNS

1: Modular gripper assembly,
10: main frame,
101: connecting rod,
102: actuator,
103: main rail,
104: centre,
2: gripper-bender device,
20: fixed part,
21: counter-bearing portion,
22: suction cup,
23: vacuum port,
200: slot,
3: support surface,
de: end spacing,
dg: group spacing,
dm: threshold margin,
E: package,
Gr: independent gripper group,
Le: package width,
Lem: package length,
Lg: group length,
Li: initial length,
Lr: reduced length,
PC: curved position,
PR: rest position,
P1: gripping position,
P2: depositing position,
O: product,
rv: adjustment of the spacing of the suction cups,
S: contact surface.

The invention claimed is:

1. A mechanised method for bending and loading one or more slender products having two longitudinal ends into at least one package, said method implementing one or more gripper-bender devices and comprising the following steps of:

/a/ gripping by the gripper-bender device(s) the product(s) in a rest position on a support surface, the rest position being defined by the or each product having an initial length between the two longitudinal ends thereof, /b/ stressing by the gripper-bender device(s) the product(s) into a curved position, the curved position being defined by the or each product having a reduced length between the two longitudinal ends thereof shorter than the initial length, and, /c/ depositing and inserting by the gripper-bender device(s) the product(s) in the curved position into said at least one package, said method further implementing a modular gripper assembly comprising a main frame comprising main rails and a plurality of gripper-bender devices slidingly mounted parallel with one another and one after another along said main rails, said gripper-bender devices regrouped into a plurality of independent gripper groups, sliding along the main rails, each gripper-bender device comprising at least one suction cup including flexible bellows, connected to at least one vacuum port for actuating a suction of the suction cup, the suction cup being configured to grasp by suction in a suction direction the product in the rest position during step /a/, and to pull by continuous suction in a retraction direction of the suction cup, collapsing the flexible bellows of the suction cup, during step /b/ by causing a movement of the product in relation to a fixed part of the gripper-bender device, and, at least one lower counter-bearing portion including at least one contact surface, configured to counter bear against the product during the retraction of the suction cup in a direction opposite to the direction of retraction of the suction cup on the product during step /b/, in order to place it in the curved position, and wherein the main frame is equipped with at least one actuator configured to slide the plurality of gripper-bender devices along the main rails:

between a gripping position wherein the gripper-benders of said independent gripper groups are grouped in a centre of the main frame juxtaposed one after another on the main rails, and each of the two ends of the main rails is left free according to an end spacing, and a depositing position, wherein the gripper-benders of the gripper groups are disposed in a spaced position, said independent gripper groups being separated from one another by a group spacing and each independent gripper group having a group length, wherein said packages are of a package length longer than the group length and are of a package width, wherein the gripper assembly is placed in the gripping position prior to step /a/, the method comprising the following steps of:

/a/ gripping by the plurality of gripper-bender devices the plurality of products which are uniformly distributed and moving on the support surface in the rest position, /b/ stressing and bending the plurality of products in the curved position by the plurality of gripper-bender devices, /c/ placing the modular gripper assembly in the depositing position wherein the plurality of gripper-bender devices gripping the plurality of products in the curved position is divided into a plurality of independent gripper groups, each independent gripper group being of the group length, and, /d/ depositing and inserting said plurality of products in the curved position gripped by each independent gripper group into each package.

2. The method according to claim 1, wherein said at least one package has a bottom and edges, and wherein depositing in /c/ is obtained in the curved position of the product(s) having the reduced length, by guaranteeing an offset between the longitudinal ends of the or of each product and the edges opposite the longitudinal ends at least greater than a threshold margin.

3. The method according to claim 2, wherein in the initial length the offset between the longitudinal ends of the or of each product and the edges opposite the longitudinal ends is less than the threshold margin.

4. The method according to claim 1, wherein the or each gripper-bender device comprises one or more suction cup(s), and wherein the gripping in /a/ is obtained by placing the suction cup(s) in contact with the product and by placing the suction cup(s) in a negative pressure, and wherein the depositing in /c/ is obtained by stopping the negative pressure.

5. The method according to claim 1, wherein the support surface is a conveyor belt, having in relief parallel slots, individually receiving the slender products.

6. The method according to claim 1, wherein the gripper-bender device(s) is (are) manipulated by a robotised arm, and wherein the robotised arm ensures the movement of the product(s) grasped by the gripper-bender device(s) from the support surface in /a/, and up to the depositing in /c/.

7. The method according to claim 1, wherein the products are food products, in particular sausages.

8. A modular gripper assembly for implementing a mechanised method for bending and loading one or more slender products having two longitudinal ends into at least one package implementing one or more gripper-bender devices and comprising the following steps of:

/a/ gripping by the gripper-bender device(s) the product(s) in a rest position on a support surface, the rest position being defined by the or each product having an initial length between the two longitudinal ends thereof, /b/ stressing by the gripper-bender device(s) the product(s) into a curved position, the curved position being defined by the or each product having a reduced length between the two longitudinal ends thereof shorter than the initial length, and, /c/ depositing and inserting by the gripper-bender device(s) the product(s) in the curved position into said at least one package, said modular gripper assembly comprising a main frame comprising main rails and a plurality of the gripper-bender devices slidingly mounted parallel with one another and one after another along said main rails, said gripper-bender devices regrouped into a plurality of independent gripper groups, sliding along the main rails, wherein each gripper-bender device comprises:

at least one suction cup including flexible bellows, connected to at least one vacuum port for actuating a suction of the suction cup, the suction cup being configured to grasp by suction in a suction direction the product in the rest position during step /a/, and to pull by continuous suction in a retraction direction of the suction cup, collapsing the flexible bellows of the suction cup, during step /b/ by causing a movement of the product in relation to a fixed part of the gripper-bender device, and, at least one lower counter-bearing portion including at least one concave contact surface, configured to counter bear against the product during the retraction of the suction cup in a direction opposite to the direction of retraction of the suction cup on the product during step /b/, in order to place it in the curved position, and wherein the main frame is equipped with at least one actuator configured to slide the plurality of gripper-bender devices along the main rails:

between a gripping position wherein the gripper-benders of said independent gripper groups are grouped in a centre of the main frame juxtaposed one after another on the main rails, and each of the two ends of the main rails is left free according to an end spacing, and a depositing position, wherein the gripper-benders of the gripper groups are disposed in a spaced position, said independent gripper groups being separated from one another by a group spacing and each independent gripper group having a group length.

9. The modular gripper assembly according to claim 8, wherein the fixed part includes a system for adjusting a spacing between the suction cup(s) and said at least one counter-bearing portion configured to permit the movement of the at least one suction cup according to at least two relative positions, comprising a first position wherein a stressing of the product on the contact surface is low, the product is slightly bent and the reduced length thereof has a first value, and a second position wherein the stressing of the product on the contact surface is strong, the product is considerably bent and the reduced length thereof has a second value, different from the first value.

10. The modular gripper assembly according to claim 9, wherein each of said gripper-bender devices, comprise three suction cups, two lateral suction cups located on either side of a central suction cup, said three suction cups including flexible bellows and each being connected to at least one vacuum port for actuating a suction of each of the three suction cups, wherein the three suction cups are configured to grasp by suction in a suction direction the product in the rest position during step /a/, and to pull by continuous suction in a retraction direction of the three suction cups, collapsing the bellows of the suction cups, during step /b/ by causing a movement of the product in relation to a fixed part of the gripper-bender device, and wherein said central suction cup is configured to retract according to a retraction amplitude greater than a retraction amplitude of said two lateral suction cups during step /b/, for placing the product in the curved position.

11. The modular gripper assembly according to claim 8, wherein said gripper-bender devices belonging to the same independent gripper group from the plurality of independent gripper groups, are secured, in pairs, by removable connecting rods, the rods engaging by two ends of each rod into two slots of the gripper-bender devices by elastic interlocking.

* * * * *